US009315301B1

(12) United States Patent
Martinez

(10) Patent No.: US 9,315,301 B1
(45) Date of Patent: Apr. 19, 2016

(54) SNACK BOTTLE WITH DISTENSIBLE DISPENSING CAP

(71) Applicant: Robert Vincent Martinez, Roseville, CA (US)

(72) Inventor: Robert Vincent Martinez, Roseville, CA (US)

( * ) Notice: Subject to any disclaimer, the term of this patent is extended or adjusted under 35 U.S.C. 154(b) by 73 days.

(21) Appl. No.: 14/299,499

(22) Filed: Jun. 9, 2014

Related U.S. Application Data

(60) Provisional application No. 61/915,719, filed on Dec. 13, 2013.

(51) Int. Cl.
*B65D 35/44* (2006.01)
*B65D 35/24* (2006.01)

(52) U.S. Cl.
CPC ..... *B65D 35/44* (2013.01); *B65D 35/245* (2013.01)

(58) Field of Classification Search
USPC ..... 222/153.09, 213, 207, 209, 215, 490, 222/494, 175
See application file for complete search history.

(56) References Cited

U.S. PATENT DOCUMENTS

| | | | | | |
|---|---|---|---|---|---|
| 1,862,662 | A | * | 6/1932 | Costello | B65D 47/2031 222/490 |
| 2,684,789 | A | * | 7/1954 | Marchant | B65D 47/127 222/212 |
| 3,349,972 | A | * | 10/1967 | Whiteford | B65D 47/2031 222/212 |
| 3,481,513 | A | | 12/1969 | Ram | |
| 3,773,233 | A | * | 11/1973 | Souza | B65D 47/2031 222/490 |
| 4,871,093 | A | | 10/1989 | Burshtain et al. | |
| 5,472,281 | A | | 12/1995 | Phelps | |
| 5,623,980 | A | | 4/1997 | McMahon | |
| 6,155,462 | A | * | 12/2000 | Brecheisen | B05B 11/001 215/276 |
| 6,722,317 | B2 | | 4/2004 | O'Rourke | |
| 7,175,069 | B1 | | 2/2007 | Tsengas | |
| 2008/0083785 | A1 | | 4/2008 | Nelson et al. | |

* cited by examiner

*Primary Examiner* — Donnell Long
(74) *Attorney, Agent, or Firm* — Williams Intellectual Property; Benjamin F. Williams

(57) ABSTRACT

A snack bottle with distensible dispensing cap that includes a deformable container portion attachable to a rubberlike dispensing cap, said dispensing cap having a slit opening rendered linearly therein, wherein deformation of the container portion by application of manual pressure thereto distends the slit opening in the dispensing cap, and snacks additional to the container portion are transmissible through the dispensing cap when the slit opening is distended, whereby snacks storable within the container portion are dispensable singlehandedly from said container portion.

3 Claims, 3 Drawing Sheets

SNACK BOTTLE WITH DISTENSIBLE DISPENSING CAP

CROSS-REFERENCE TO RELATED APPLICATIONS

This application claims the benefit of provisional application No. 61/915,719 filed on Dec. 13, 2013.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of snack bottles are known in the prior art. However, what is needed is a snack bottle with distensible dispensing cap that includes a deformable container portion attachable to a rubberlike dispensing cap, said dispensing cap having a slit opening rendered therein, wherein deformation of the container portion by application of manual pressure thereto distends the slit opening in the dispensing cap, and snacks additional to the container portion are transmissible through the dispesning cap when the slit opening is distended, whereby snacks are dispensable from the container portion singlehandedly.

FIELD OF THE INVENTION

The present invention relates to a snack bottle with distensible dispensing cap, and more particularly, to a snack bottle with distensible dispensing cap that includes a deformable container portion attachable to a rubberlike dispensing cap, said dispensing cap having a slit opening rendered therein, wherein deformation of the container portion by application of manual pressure thereto distends the slit opening in the dispensing cap, and snacks additional to the container portion are transmissible through the dispensing cap when the slit opening is distended, whereby snacks are dispensable from the container portion singlehandedly.

SUMMARY OF THE INVENTION

The general purpose of the snack bottle with distensible dispensing cap, described subsequently in greater detail, is to provide a snack bottle with distensible dispensing cap which has many novel features that result in a snack bottle with distensible dispensing cap which is not anticipated, rendered obvious, suggested, or even implied by prior art, either alone or in combination thereof.

The present snack bottle with distensible dispensing cap has been devised to enable singlehanded ingestion of snacks stored within a container portion, whereby one hand of a user is able to administer to a particular task, such as operating an automobile, for example, coincident the action to ingest said snacks.

The present snack bottle with distensible dispensing cap, therefore, includes a deformable container portion attachable to a rubberlike dispensing cap. The container portion has an open end attachable to the dispensing cap. A locking rim is disposed atop the open end and thereat engages with the dispensing cap. When the container portion is deformed by application of manual pressure thereto, said pressure applied across a transverse axis thereof, the locking rim communicates such deformation to the dispensing cap, and a slit opening, disposed at a top end of the dispensing cap, is thereby distended into a rounded, or ovoid, open position, whereby snacks storable interior to the container portion are transmissible through the distended slit opening for ingestion, as desired.

The dispensing cap is a frustoconical, rubberlike member, elongated along a transverse axis thereof, and configured to attach to the container portion open end. The dispensing cap includes a rounded top end whereupon the slit opening is disposed. The slit opening is distensible, from a closed position wherein the slit opening is closed and linearly disposed upon the top end of the dispensing cap, to an open position, wherein the slit opening is separable into a rounded configuration bordering an ovoid aperture through which snacks stored in the container portion are thence transmissible.

The dispensing cap further includes a plurality of locking members disposed for releasable engagement with each of a respective plurality of locking member recesses disposed upon the container portion proximal the open end. Each of the plurality of locking members is releasable, whereby the dispensing cap is securable to the container portion and removable therefrom, as desired.

A belt clip is included, said belt clip disposed upon the container portion for selective attachment of the device to a person or to an other surface to which said belt clip is attachable, whereby convenient storage and access to the snack bottle with distensible dispensing cap is afforded a user, when desired.

Thus has been broadly outlined the more important features of the present snack bottle with distensible dispensing cap so that the detailed description thereof that follows may be better understood and in order that the present contribution to the art may be better appreciated.

Objects of the present snack bottle with distensible dispensing cap, along with various novel features that characterize the invention are particularly pointed out in the claims forming a part of this disclosure. For better understanding of the snack bottle with distensible dispensing cap, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
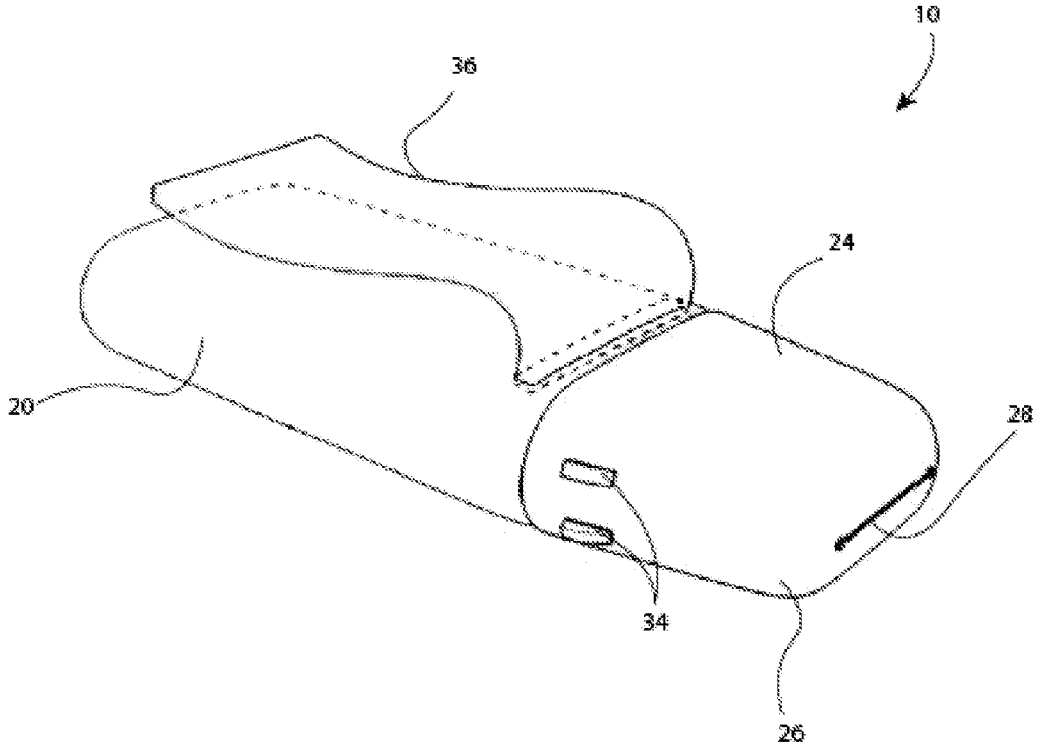
FIG. 1 is an isometric view.
Figure 2:
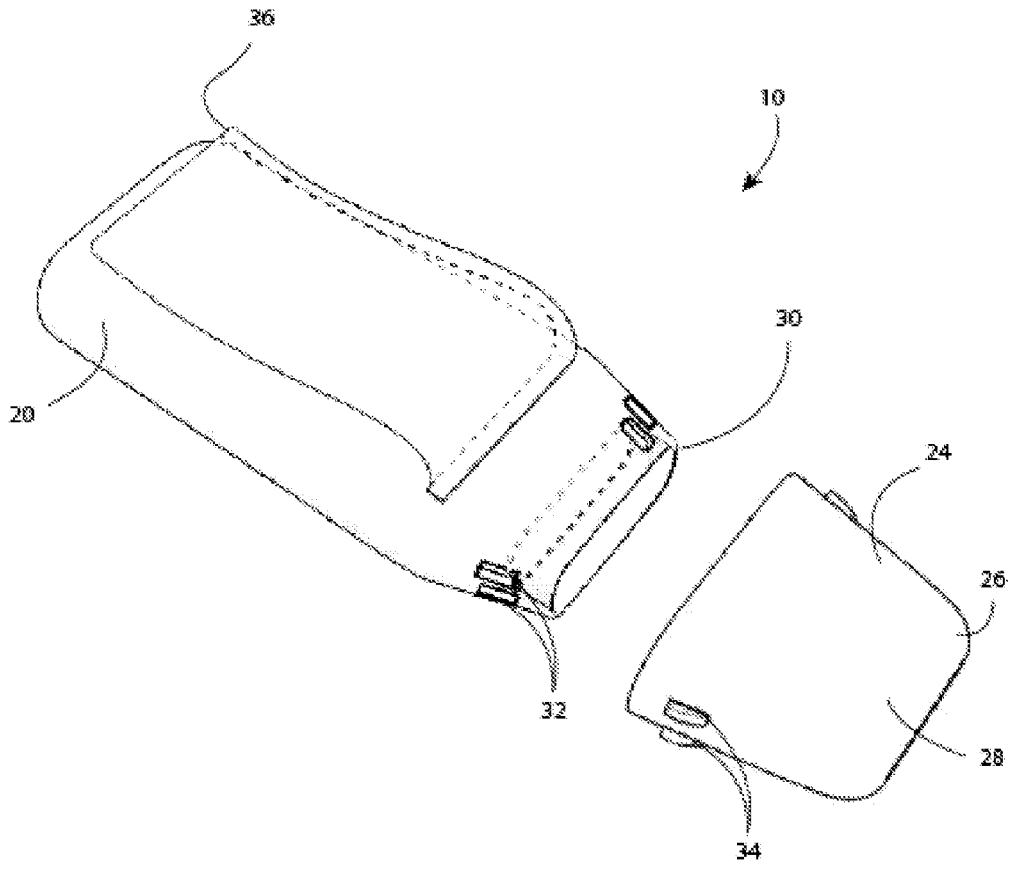
FIG. 2 is a isometric view with a dispensing cap unattached.
Figure 3:
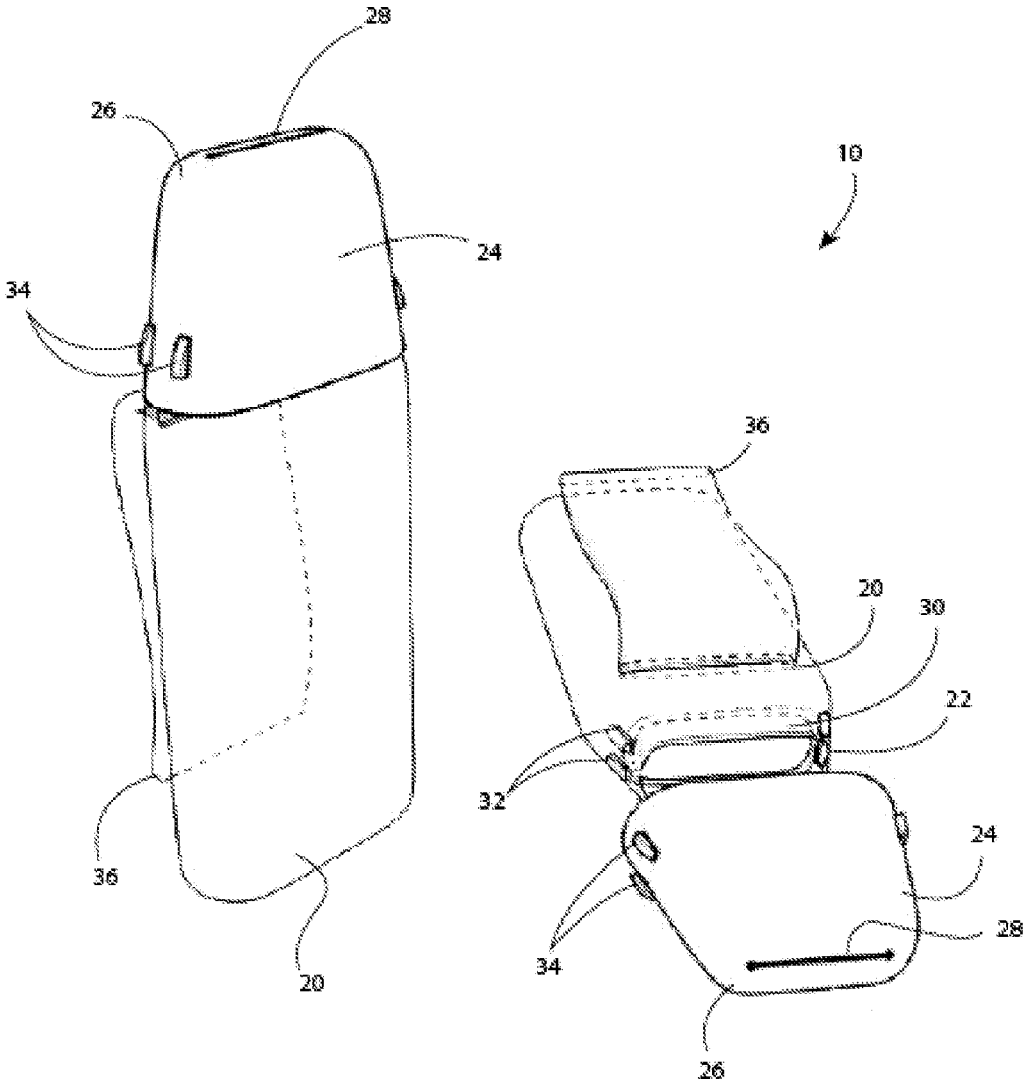
FIG. 3 is an isometric view of a pair of snack bottles with dispensing caps, one of said pair having the dispensing cap attached and the other of said pair having the dispensing cap unattached.

With reference now to the drawings, and in particular FIGS. 1 through 3 thereof, example of the instant snack bottle with distensible dispensing cap employing the principles and concepts of the present snack bottle with distensible dispensing cap and generally designated by the reference number 10 will be described.

Referring to FIGS. 1 through 3 a preferred embodiment of the present snack bottle with distensible dispensing cap 10 is illustrated.

The present snack bottle with distensible dispensing cap 10 has been devised to enable expedient dispensation of snacks contained interior thereto through a rubberlike dispensing cap, whereby squeezing the snack bottle with distensible dispensing cap effects opening of the dispensing cap and thereby enables passage of snacks therethrough. A user is thus enabled dispensation of snacks with a single hand.

The present snack bottle with distensible dispensing cap 10, therefore, includes a deformable container portion 20 having an open end 22. A dispensing cap 24 is attachable at the open end 22. The dispensing cap 24 is a frustoconical, rubberlike member, elongated along a transverse axis thereof, and conformed for attachment at the open end 22 of the container portion 20.

The dispensing cap 24 includes a rounded top end 26. A slit opening 28 is disposed linearly at the top end 26. The slit opening 28 is distensible from a closed position, wherein the slit opening 28 is linearly disposed at the top end 26, to an open position, wherein the slit opening 28 is distended into a rounded or ovoid configuration, whereby an aperture is formed through which snacks stored in the container portion 20 are dispensable.

The container portion 20 includes a locking rim 30 disposed bounding the open end 22. The locking rim 30 is disposed for insertible engagement into the dispensing cap 24. The locking rim 30 includes a plurality of locking member recesses 32 disposed for releasable engagement with a plurality of locking members 34 disposed upon the dispensing cap 24. Each of the plurality of locking members 34 disposed upon the dispensing cap 24 is depressible, and each of said plurality of locking members 34 is disposed to click into a respective one of the plurality of locking member recesses 32 disposed upon the locking rim 30 of the container portion 20. Depression of the plurality of locking members 34 when the dispensing cap 24 is attached at the open end 22 of the container portion 20 releases the dispensing cap 24 from the locking rim 30 of the container portion 20.

The container portion 20 is deformable by application of manual pressure across a transverse axis thereof, whereby the slit opening 28 in the dispensing cap 24 is distended to the open position. Snacks additional to the container portion 20 are therefore dispensable from within the container portion 20 through the aperture formed when the slit opening 28 at the top end 26 of the dispensing cap 24 is distended. Release of said manual pressure thence restores the container portion 20 to its initial shape, and the slit opening 28 is returned to the closed position, whereby the slit opening 28 is linearly deployed at the top end 26 of the dispensing cap 24, said slit opening 28 effectively sealed closed by contact of opposing edges delimiting the slit opening 28.

A user is thus enabled dispensation of snacks storable within the container portion 20 with a single hand by simply orienting the container portion 20 appropriate for introduction of snacks therein into the mouth, and thence squeezing the container portion 20. Thus, when attending to additional tasks, such as operating a motor vehicle, for example, a user is able to ingest snacks while superintending the task at hand, such as, in the present example here elicited, by maintaining a hand upon a steering wheel.

The container portion 20 also includes a belt clip 36 disposed for attachment of the device 10 to a belt worn by a user, or to another such surface to which said belt clip 36 is attachable, whereby convenient storage of the device 10 is effective proximal a user or at a site proximal a particular task at hand.

What is claimed is:

1. A snack bottle with distensible dispensing cap enabling one-handed dispensation of snacks, said snack bottle with distensible dispensing cap comprising:

a deformable container portion having an open end;

a rubberlike dispensing cap attachable at the open end;

a rounded top end disposed upon the dispensing cap;

a locking rim disposed bounding the open end;

a plurality of locking member recesses disposed upon the locking rim;

a depressible plurality of locking members disposed upon the dispensing cap, each of said locking members positional engaged in each of the plurality of locking member recesses when the dispensing cap is attached at the open end, each of said depressible plurality of locking members depressible thereat to release contact with each of the plurality of locking member recesses to remove the dispensing cap when desired; and a slit opening disposed linearly upon the top end, said slit opening distensible between a sealable closed position and an open position;

wherein the deformable container portion is deformable when manual pressure is applied across a transverse axis thereof, said deformation of the deformable container portion distending the slit opening in the open position, wherein release of said applied pressure retracts the slit opening to the closed position, whereby snacks are dispensable from, and storable within, said deformable container.

2. The snack bottle with distensible dispensing cap of claim 1 further comprising a belt clip disposed upon the deformable container whereby the container portion is attachable upon a belt of a user.

3. A snack bottle with distensible dispensing cap enabling one-handed dispensation of snacks comprising:

a deformable container portion having an open end;

a locking rim disposed bounding the open end;

a plurality of locking member recesses disposed upon the locking rim;

a frustoconical rubberlike dispensing cap attachable at the open end;

a plurality of depressible locking members disposed upon the dispensing cap, each of said plurality of locking members releasably attachable to each of the plurality of locking recesses;

a rounded top end disposed upon the dispensing cap; and a slit opening disposed linearly upon the top end, said slit opening distensible between a sealable closed position and an open position;

wherein the deformable container portion is deformable when manual pressure is applied across a transverse axis thereof, said deformation of the deformable container portion distending the slit opening in the open position, wherein release of said applied pressure retracts the slit opening to the closed position, whereby snacks are dispensable from, and storable within, said deformable container.

* * * * *